US005593191A

United States Patent [19]

DeMarco

[11] Patent Number: 5,593,191

[45] Date of Patent: Jan. 14, 1997

[54] AUTOMATIC PIN-TYPE DOOR LOCK ASSEMBLY FOR HOBBY CARS

[76] Inventor: Stephen R. DeMarco, Rte. 3, Box 376-M, Clinton, N.C. 28328

[21] Appl. No.: 488,681

[22] Filed: Jun. 8, 1995

[51] Int. Cl.[6] ..... E05C 1/06

[52] U.S. Cl. ..... 292/144; 292/142

[58] Field of Search ..... 292/142–144

[56] References Cited

U.S. PATENT DOCUMENTS

| | | | |
|---|---|---|---|
| 3,893,723 | 7/1975 | Boule | 292/144 X |
| 4,030,322 | 6/1977 | Pettit | 292/144 |
| 4,225,164 | 9/1980 | Wensley et al. | 292/144 X |
| 4,917,419 | 4/1990 | Mora, Jr. et al. | 292/144 |
| 5,029,912 | 7/1991 | Gotanda | 292/143 |
| 5,280,881 | 1/1994 | Karmin | 292/144 X |
| 5,441,315 | 8/1995 | Kleefeldt et al. | 292/144 X |
| 5,511,832 | 4/1996 | Künzel | 292/144 |
| 5,531,086 | 7/1996 | Bryant | 292/142 X |

*Primary Examiner*—Steven N. Meyers
*Assistant Examiner*—Monica E. Millner
*Attorney, Agent, or Firm*—Rhodes, Coats & Bennett, L.L.P.

[57] ABSTRACT

An automatic pin-type door lock assembly for locking the door of a hobby-type car is disclosed. The door lock assembly includes a mounting frame structure having a locking pin movably mounted therein. An electric actuator is secured to the mounting frame structure and connected to the locking pin and operative to move the locking pin back and forth between a disengaged position and a locked position.

5 Claims, 5 Drawing Sheets

AUTOMATIC PIN-TYPE DOOR LOCK ASSEMBLY FOR HOBBY CARS

FIELD OF THE INVENTION

The present invention relates to hobby cars and to accessories and kits therefore, and more particularly to an automatic pin-type locking assembly that is particularly useful in a suicide-type door to securely lock the door to an adjacent door jamb or post.

BACKGROUND OF THE INVENTION

Hobby-type cars such as hot rods and the like are very popular throughout the United States and other parts of the world. Such hobby-type cars are usually constructed and built from kits. Many hobby cars employ what is referred to as "suicide" doors. A suicide door hinges about the rear edge and consequently opens by swinging the door from front to back. There is, however, a safety concern with respect to suicide doors.

In some applications, suicide doors are prone to pop open while the vehicle is moving. Instinctually, the car driver often attempts to reach out and catch the door to pull it closed. This can be a very dangerous undertaking. This is because the person attempting to gain control of the door can in the process be effectively pulled from the car.

Also, in other types of hobby or custom constructed car, the doors do not include an integral door latch assembly. Consequently, in these situations the vehicle owner does not have a convenient and effective way of securely locking the doors to these vehicles.

Therefore, there has been and continues to be a need in the hobby car field for an effective door locking mechanism that can be easily installed and operated to maintain the doors of hobby cars in a secure and locked position when desired.

SUMMARY AND OBJECTS OF THE INVENTION

The present invention entails an automatic pin-type locking assembly adapted to be installed in the door or other frame structure of a hobby-type car. The automatic pin-type locking assembly of the present invention includes a locking pin that is driven by an electric actuator or solenoid device between a disengaged position and a locked position. In the locked position, the locking pin extends between the door and an adjacent frame structure such as a post or door jamb so as to securely lock the door to the door jamb or post structure. In addition, the automatic locking assembly of the present invention includes a manual override mechanism that allows a person to manually lock or unlock the locking pin in the event of a power failure or a failure of the electric actuator itself.

It is therefore an object of the present invention to provide an automatic pin-type door lock assembly that is designed to pin lock a door in a closed position to the frame or adjacent structure of the vehicle.

Another object of the present invention is to provide an automatic pin-type locking assembly of the character referred to above with a manual override mechanism.

Still a further object of the present invention is to provide an automatic pin-type door locking assembly of the character referred to above in a kit formed that is easy to install in a door of a vehicle.

Another object of the present invention is to provide an effective automatic pin-type door locking assembly that is particularly suitable for being mounted within a suicide-type door commonly found on hobby or custom cars.

Other objects and advantages of the present invention will become apparent and obvious from a study of the following description and the accompanying drawings which are merely illustrative of such invention.

DETAILED DESCRIPTION OF THE INVENTION

Figure 1:
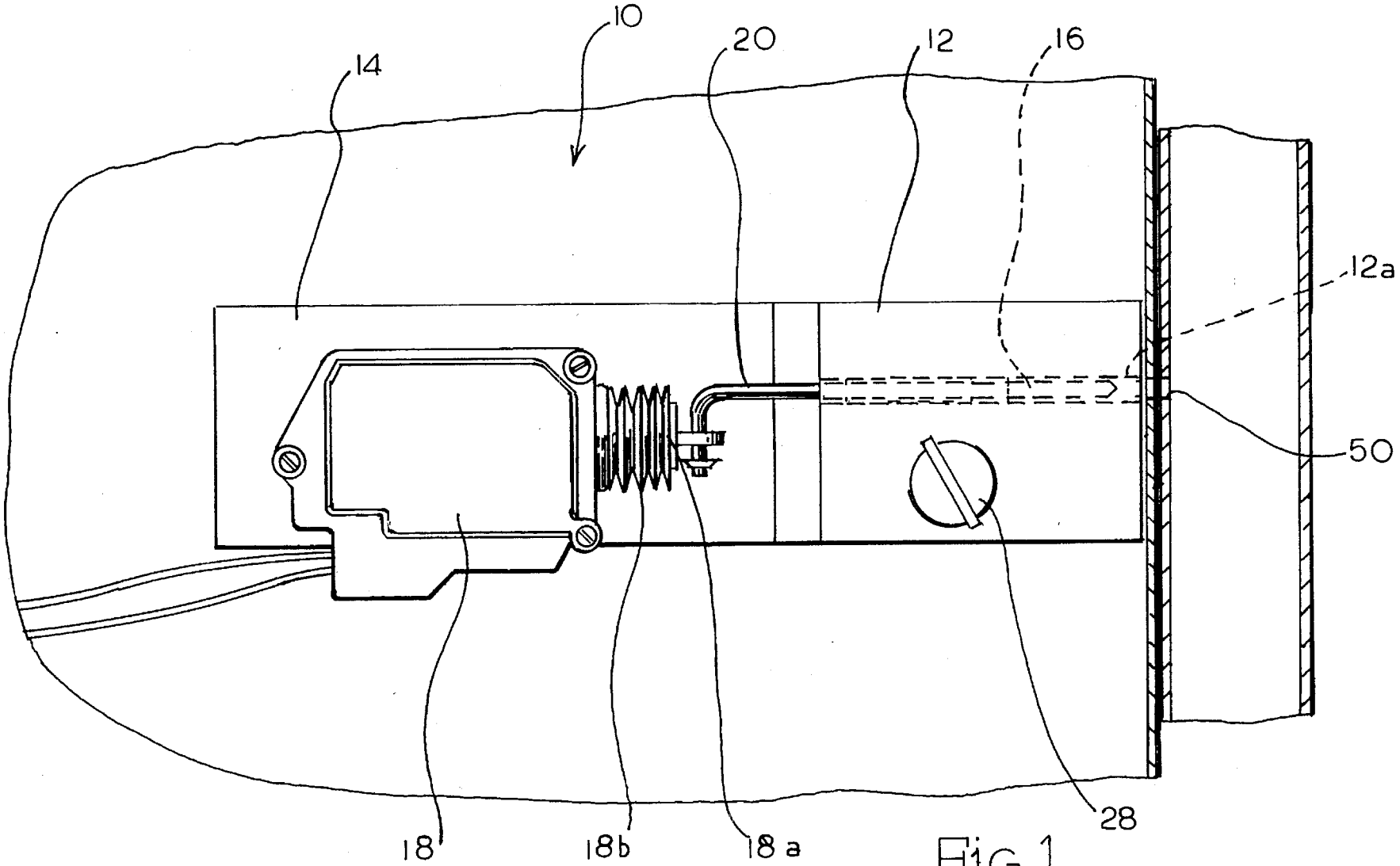
FIG. 1 is a side elevational view showing the automatic pin-type door lock assembly installed on a door of a vehicle and disposed in the unlocked position.
Figure 2:
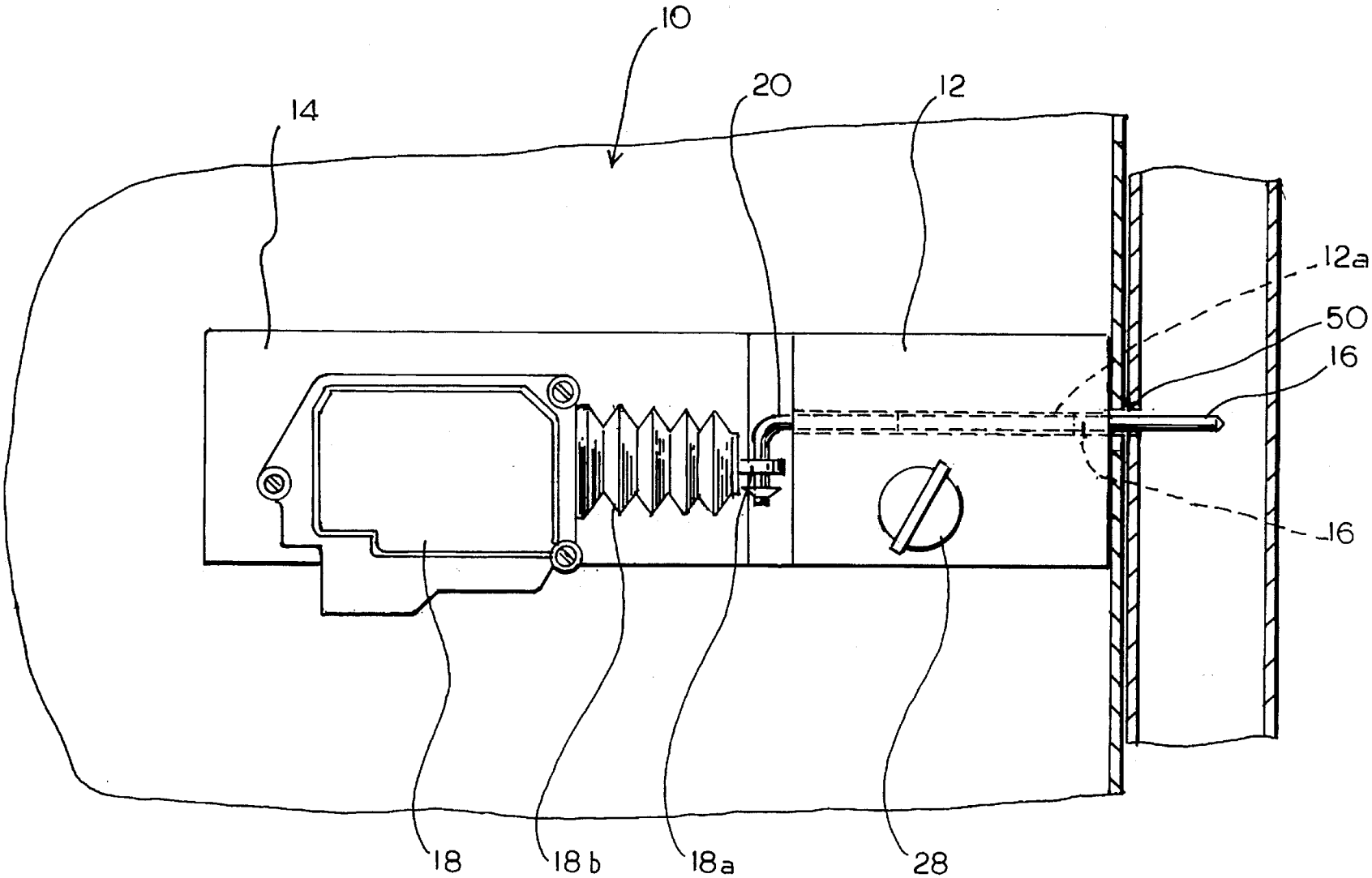
FIG. 2 is a side elevational view of the automatic pin-type door lock assembly of the present invention shown in the locked position.
Figure 3:
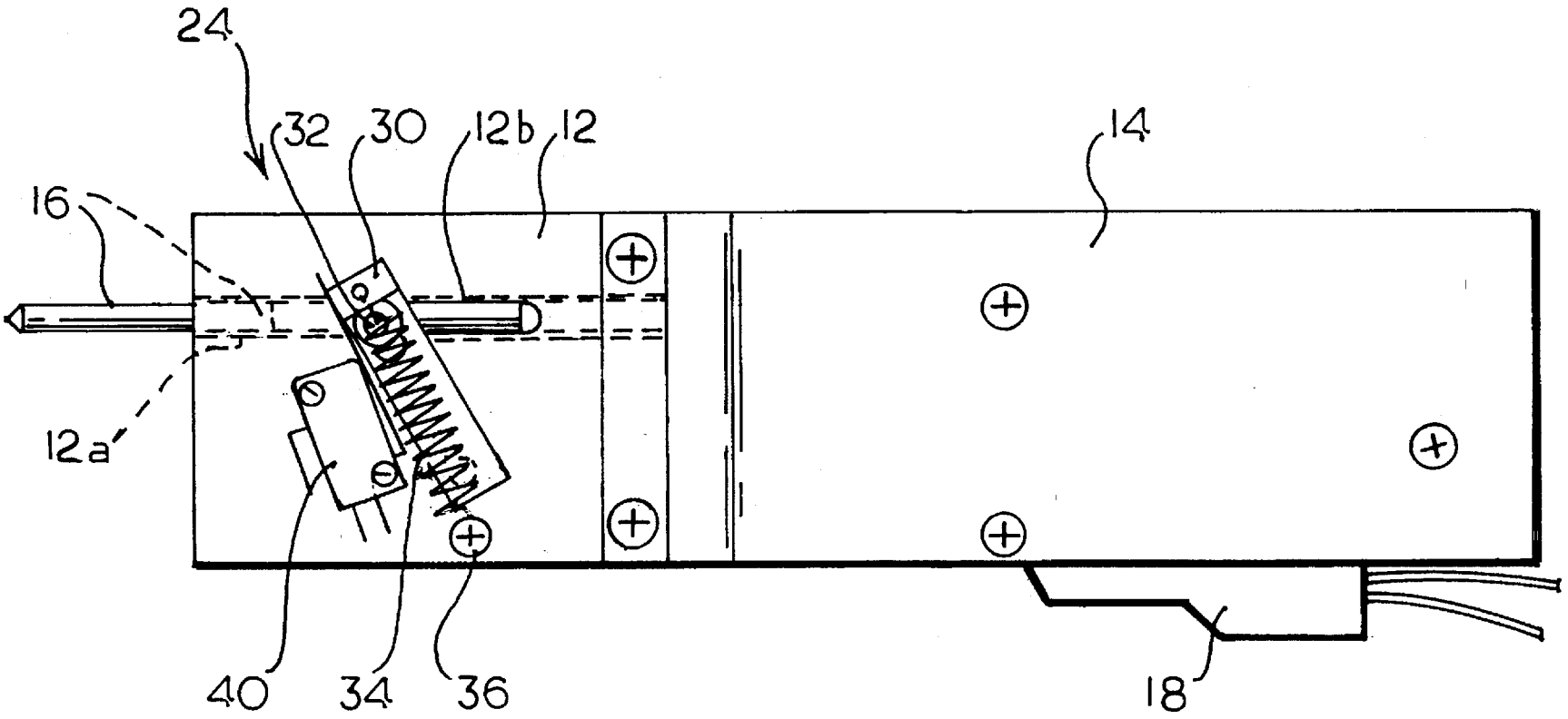
FIG. 3 is a side elevational view of the opposite side of the pin-type door lock assembly from that shown in FIG. 2.
Figure 4:
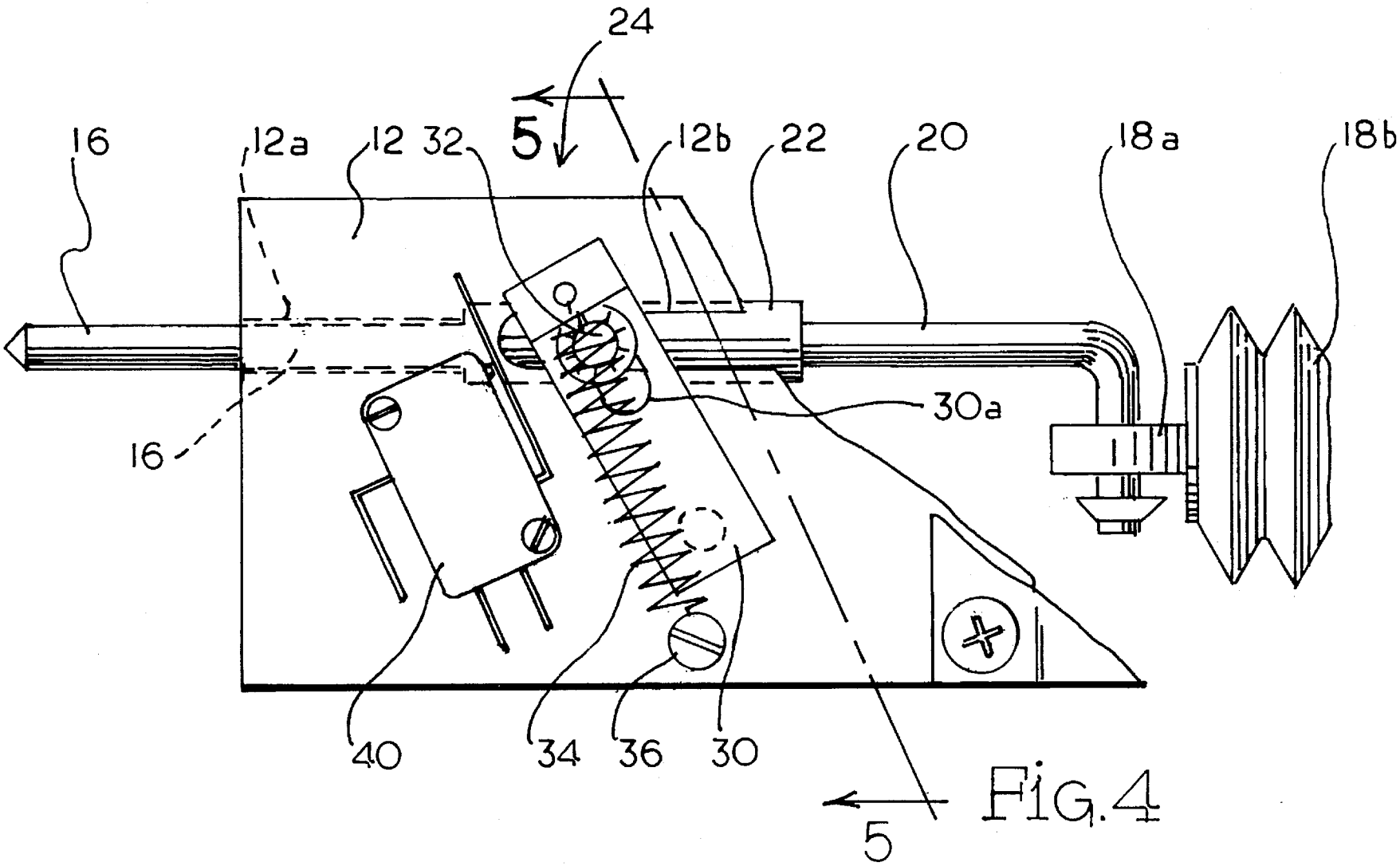
FIG. 4 is a fragmentary side elevational view of a portion of the pin-type door lock assembly of the present invention.
Figure 5:
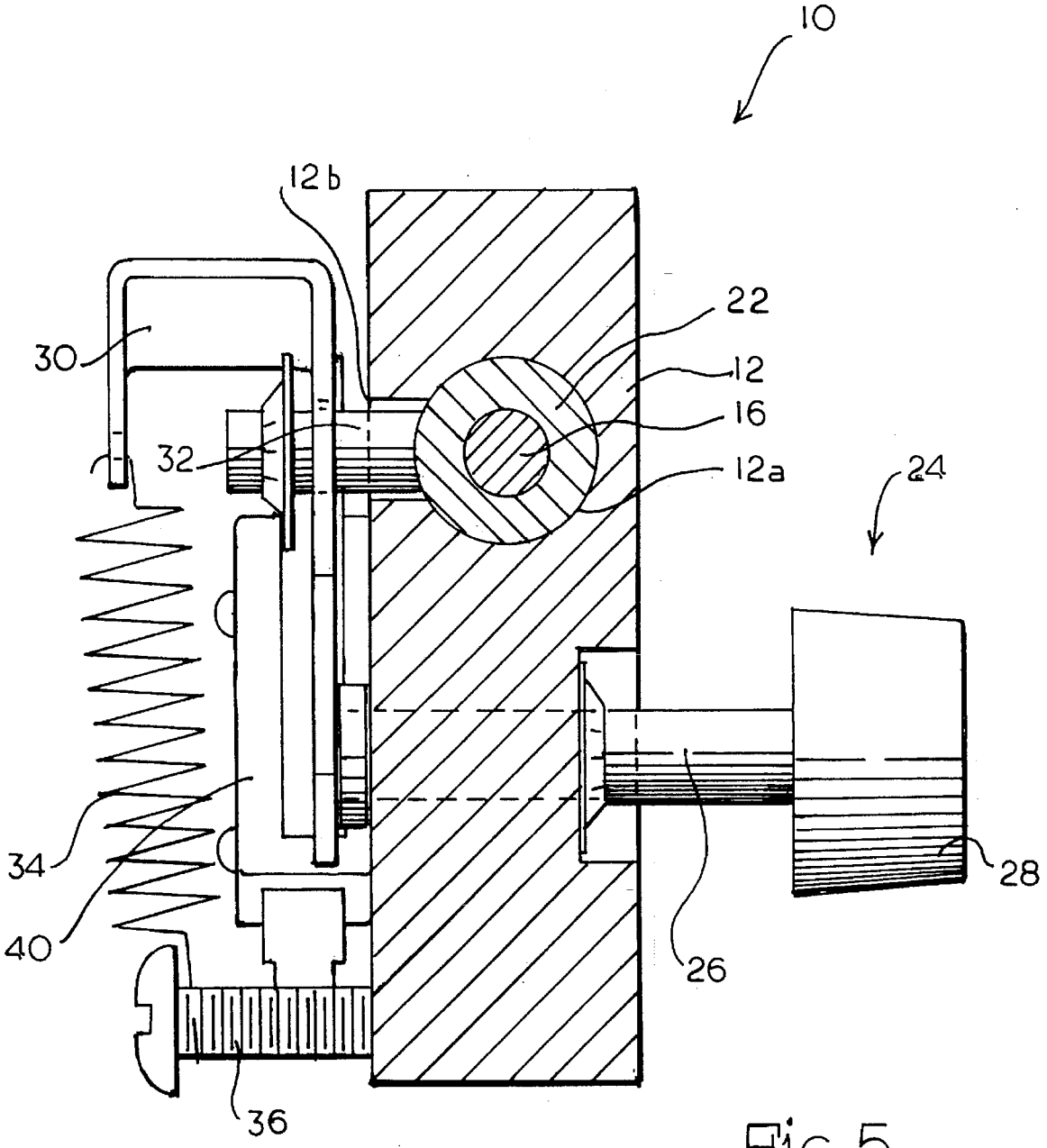
FIG. 5 is a sectional view taken through the lines 5—5 of FIG. 4.

With further reference to the drawings, the automatic pin-type locking assembly is shown therein and indicated generally by the numeral 10. Viewing the locking pin assembly 10 in more detail, it is seen that the same includes a mounting frame structure that includes a block housing 12 and a plate 14 secured to the block housing 12 and extending therefrom. The housing 12 includes a throughbore 12*a* that extends from one edge of the housing to the other edge. Formed on one side of the housing 12 adjacent the throughbore 12*a* is an elongated open slot 12*b*. As seen in FIG. 3, the open slot 12*b* is open to the throughbore 12*a*.

Secured within the throughbore 12*a* of housing 12 is an elongated locking pin 16. As will be appreciated from this disclosure, locking pin 16 is confined within the throughbore 12*a* but is movable back and forth therein between a disengaged position and a locked position.

To actuate locking pin 16 there is provided an electric actuator 18 of the solenoid type. Electric actuator 18 is mounted to the support plate 14 that is in turn supported by the block housing 12. Electric actuator 18 is designed to be powered by the vehicle battery and includes a reciprocating extender 18*a* that is housed by a flexible boot 18*b*. The electric actuator 18 is mounted to plate 14 such that the extender 18*a* is generally aligned with the throughbore 12*a* of the housing such that the extender 18*a* is effective to drive the locking pin 16 back and forth within the throughbore 12*a* between the disengaged position and the locked position.

A connector link 20 is connected to the extender 18*a* and extends therefrom into the throughbore 12*a* of housing 12. The connector link 20 is connected to the locking pin 16 by a coupler sleeve 22. It is appreciated that the coupler sleeve 22 is likewise confined within the throughbore 12*a* and effectively connects the connector link 20 with the locking pin 16. Thus, as the extender 18*a* of the electric actuator 18 is moved back and forth, the locking pin 16 is likewise moved back and forth within the throughbore 12*a* due to the fact that the extender 18*a*, connector link 20, coupler 22 and locking pin 16 are all secured or tied together.

The locking pin assembly 10 of the present invention also includes a manual override mechanism mounted on the housing 12 and indicated generally by the numeral 24. With further reference to the manual override mechanism 24, it is seen that the same includes a rotating shaft 26 rotatively journaled within the housing 12. Shaft 26 includes an outer knob 28. Secured to an end portion of the shaft 26 adjacent the side of the housing 12 is a swing arm 30 that includes an elongated slot 30*a* formed therein. A connecting pin 32 extends laterally through the open slot 12*b* and extends through the slot 30*a* of the swing arm 30. Connecting pin 32 is secured to either the locking pin 16, coupler 22, or connector link 20. Effectively, the connecting pin should be connected in such a fashion that it moves back and forth as the locking pin 16 moves back and forth. In the case of the present design, the connecting pin 32 is secured to the coupler 22 and extends outwardly therefrom through the open slot 12*b*.

A spring 34 is secured on the side of the housing 12 adjacent the swing arm 30. The spring is anchored at one end by a screw 36 while the other end of the spring is secured to the arm 30 above the pivot point of the same arm. The spring 34 is oriented such that as the arm 30 swings back and forth, the spring passes "over center" and consequently biases the arm 30 to either one of two opposed positions. Thus, the spring 34 encourages or biases the arm 30 to assume one of its two extreme positions.

Also, secured on the mounting frame structure is a microswitch 40. The purpose of the microswitch 40 is to appraise an individual whether the locking pin assembly is in the locked mode or the disengaged mode. Consequently, the microswitch 40 is positioned such that it is actuated between an "on" and "off" position as the locking pin 16 is moved between the disengaged and locked positions. Although not shown, the microswitch would be connected to a signaling or indicator device that would indicate the position assumed by the locking pin 16.

The locking pin assembly 10 of the present invention can be mounted within a door structure or in an adjacent frame structure of a vehicle. However, in many cases it is contemplated that the locking pin assembly 10 would in fact be mounted within the door and positioned therein such that when the locking pin 16 assumes the disengaged position that the door can be opened and closed without the locking pin 16 providing any obstruction or interference. However, formed adjacent the locking pin 16 in the vehicle would be a pin opening 50 for receiving the locking pin 16 when the same assumes a locked position. Thus, when the locking pin assembly 10 is mounted within a door structure, the pin opening 50 would be formed in an adjacent structure such as a door post or door jamb. In any event, the pin opening 50 should be aligned with the locking pin 16 such that when the locking pin 16 is extended to a locked position the locking pin extends into and is confined within the pin opening 50. This creates a locked door situation.

To actuate the locking pin assembly 10, the electric actuator 18 can be actuated by a conventional switch. By engaging the switch, the electric actuator 18 will effectively move the locking pin 16 back and forth between the disengaged position and the locked position.

Also, the manual override mechanism 24 can be used to move the locking pin 16 independently of the electric actuator 18. By rotating shaft 26 back and forth, it is seen that the swing arm 30 is likewise moved back and forth. Because connecting pin 32 is confined within slot 30*a* of swing arm 30, the swing arm effectively moves the locking pin 16 back and forth between the disengaged position and the locked position. Spring 34 assists in manually locking and unlocking the locking pin assembly 10 since it is essentially a part of a "over center" arrangement and biases the arm 30 towards one of two extreme positions once the swing arm has been rotated past what is referred to as a center line. Consequently, in cases where there is a power failure or where there is a failure with the electric actuator 18, the locking pin assembly 10 of the present invention can still be operated mainly by the override mechanism 24.

It should also be pointed out that the pin-type door locking assembly 10 of the present invention can be remotely actuated by a conventional remote that is appropriately programmed.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An automatic pin-type locking assembly with a manual override mechanism for locking the door of a hobby-type car comprising:

a) a mounting frame structure;

b) a locking pin movably mounted within the frame structure;

c) an electric actuator secured to the frame structure and operatively connected to the locking pin for moving the locking pin back and forth between a retracted disengaged position and an extended locked position;

d) an overcenter type manual override mechanism secured on the mounting frame structure for manually moving the locking pin between the disengaged and locked positions independently of the electric actuator, including:

i) a rotary shaft;

ii) a hand actuator for rotating the rotary shaft;

iii) an arm including a slot and fixed to the rotary shaft at one end, the arm being rotatable back and forth with the rotary shaft;

iv) a connecting pin extending from the locking pin through the slot within the arm such that as the arm is rotated back and forth via the rotation of the rotary shaft, the locking pin is likewise caused to move back and forth between the disengaged and locked positions, independently of the electric actuator; and v) a spring connected at one end to an anchor point and connected at the other end to the arm for biasing the same over center towards either the disengaged position or the locked position in response to the rotary shaft being rotated.

2. The automatic pin-type locking assembly of claim 1 wherein the mounting frame structure includes a housing having a throughbore formed therein and wherein the locking pin is confined within the throughbore and moves back and forth therein.

3. The automatic pin-type locking assembly of claim 2 wherein the electric actuator includes an extender that moves back and forth in response to the electric actuator being actuated and wherein the extender is operatively connected to the locking pin for moving the same back and forth.

4. The automatic pin-type locking assembly of claim 3 wherein in the locking assembly is provided with a microswitch that is opened and closed in response to the locking pin moving between the disengaged and locked positions, whereby the microswitch is connected to a signaling device for indicating whether the locking pin is in the disengaged or locked position.

5. The automatic pin-type locking assembly of claim 1 wherein the mounting frame structure includes a housing with a throughbore formed therein and wherein the locking pin is confined within the throughbore and movable back and forth therein, and wherein there is provided a side opening slot in the housing adjacent the throughbore and wherein the connecting pin that connects the arm of the override mechanism with the locking pin extends through the side slot formed in the housing structure.

* * * * *